US011047623B2

(12) United States Patent
Zheng

(10) Patent No.: US 11,047,623 B2
(45) Date of Patent: Jun. 29, 2021

(54) GRAIN DRYER AND METHOD FOR USING THE SAME

(71) Applicant: SATAKE CORPORATION, Tokyo (JP)

(72) Inventor: Jun Zheng, Tokyo (JP)

(73) Assignee: SATAKE CORPORATION, Tokyo (JP)

( * ) Notice: Subject to any disclaimer, the term of this patent is extended or adjusted under 35 U.S.C. 154(b) by 212 days.

(21) Appl. No.: 16/330,570

(22) PCT Filed: Aug. 25, 2017

(86) PCT No.: PCT/JP2017/030613

§ 371 (c)(1),
(2) Date: Mar. 5, 2019

(87) PCT Pub. No.: WO2018/047640

PCT Pub. Date: Mar. 15, 2018

(65) Prior Publication Data

US 2021/0055051 A1 Feb. 25, 2021

(30) Foreign Application Priority Data

Sep. 6, 2016 (JP) ..... JP2016-174115

(51) Int. Cl.
*F26B 17/14* (2006.01)
*F26B 21/00* (2006.01)
*F26B 3/06* (2006.01)

(52) U.S. Cl.
CPC ..... *F26B 17/1425* (2013.01); *F26B 3/06* (2013.01); *F26B 21/001* (2013.01); *F26B 21/006* (2013.01); *F26B 2200/06* (2013.01)

(58) Field of Classification Search
CPC ..... F26B 17/1425; F26B 3/06; F26B 21/001; F26B 21/006; F26B 2200/06
(Continued)

(56) References Cited

U.S. PATENT DOCUMENTS 3,896,562 A * 7/1975 Zimmerman ..... F26B 17/124 34/174
4,125,945 A * 11/1978 Westelaken ..... A23B 9/08 34/167

(Continued)

FOREIGN PATENT DOCUMENTS

CN 102369996 A 3/2012
CN 103859019 A 6/2014

(Continued)

*Primary Examiner* — Stephen M Gravini
(74) *Attorney, Agent, or Firm* — Faegre Drinker Biddle & Reath LLP

(57) ABSTRACT

There is provided a grain dryer in which the whole of a dryer main body can be made effective use of whether the grain dryer is used in either a circulation drying mode or in a continuous flow drying mode, the grain dryer including a dryer main body into which grains are loaded, a hot air chamber provided at one side of the dryer main body to supply hot air into an interior of the dryer main body, and an exhaust air chamber provided at the other side of the dryer main body to discharge hot air from the interior of the dryer main body, wherein the hot air chamber and the exhaust air chamber each have a plurality of upper and lower independent spaces, the corresponding spaces of the hot air chamber and the exhaust air chamber being disposed to be positioned substantially at a same height, and wherein the individual spaces of the hot air chamber communicate with corresponding hot air generators to execute separate supplies of hot air generated by the hot air generators into the individual spaces, and a height range in the interior of the dryer main body into which hot air is supplied from the spaces of the hot air chamber is defined as a drying section to dry grains loaded into the interior of the dryer main body.

19 Claims, 7 Drawing Sheets

(58) Field of Classification Search
USPC ..... 34/565
See application file for complete search history.

(56) References Cited

U.S. PATENT DOCUMENTS

| | | | | | |
|---|---|---|---|---|---|
| 4,686,779 | A * | 8/1987 | Wyatt | F26B 3/16 | 34/168 |
| 4,784,216 | A * | 11/1988 | Bracegirdle | F26B 23/10 | 165/110 |
| 5,052,123 | A * | 10/1991 | Tischendorf | B29B 13/065 | 34/418 |
| 5,167,081 | A * | 12/1992 | Loyns | F26B 9/085 | 34/170 |
| 5,685,434 | A * | 11/1997 | Ackerman | B07B 4/02 | 209/135 |
| 6,223,451 | B1 * | 5/2001 | Satake | F26B 9/087 | 34/134 |
| 7,818,894 | B2 * | 10/2010 | Noyes | F26B 17/122 | 34/169 |
| 8,291,609 | B2 * | 10/2012 | Zoucha | F26B 3/305 | 34/267 |
| 8,342,117 | B2 * | 1/2013 | Fukumori | A23L 7/1963 | 118/16 |
| 8,973,285 | B2 * | 3/2015 | Fujitomo | F26B 17/1416 | 34/565 |
| 9,506,693 | B2 * | 11/2016 | Pauling | F26B 17/14 | |
| 9,719,722 | B2 * | 8/2017 | Fujitomo | F26B 23/002 | |
| 9,848,628 | B1 * | 12/2017 | Strahm | F26B 21/02 | |
| 9,863,703 | B2 * | 1/2018 | Morrison | F26B 23/002 | |
| 9,915,474 | B2 * | 3/2018 | Pauling | F26B 17/122 | |
| 10,470,474 | B2 * | 11/2019 | Valfiorani | F26B 23/02 | |
| 10,767,926 | B2 * | 9/2020 | Heilskov | F26B 17/128 | |
| 2006/0150436 | A1 | 7/2006 | Tada et al. | | |
| 2013/0036624 | A1 | 2/2013 | Fujitomo | | |
| 2014/0250718 | A1 * | 9/2014 | Fujitomo | F26B 23/002 | 34/565 |
| 2016/0040932 | A1 * | 2/2016 | Ayala Barreto | F26B 17/1416 | 34/167 |

FOREIGN PATENT DOCUMENTS

| | | | | |
|---|---|---|---|---|
| JP | S58-167893 | U | 11/1983 | |
| JP | S59-40792 | U | 3/1984 | |
| JP | H04-60379 | A | 2/1992 | |
| JP | 2559148 | Y2 | 1/1998 | |
| JP | 3743547 | B2 * | 2/2006 | F26B 17/16 |
| JP | 5939258 | B2 * | 6/2016 | F26B 23/002 |
| TW | I328670 | B | 8/2010 | |
| TW | M393996 | U1 | 12/2010 | |
| WO | WO-2011/132481 | A1 | 10/2011 | |

* cited by examiner

GRAIN DRYER AND METHOD FOR USING THE SAME

CROSS REFERENCE TO PRIOR APPLICATIONS

This application is the National Stage of International Application No. PCT/JP2017/030613 filed Aug. 25, 2017 and claims benefit of Japanese Application No. 2016-174115 filed on Sep. 6, 2016, which are herein incorporated by reference in their entirety.

TECHNICAL FIELD

The present invention relates to a grain dryer capable of drying various types of grains such as rough rice, wheat or the like and preferable for use in two drying modes including a circulation drying mode and a continuous flow drying mode. The present invention further relates to a method for using the grain dryer.

BACKGROUND ART

It is conventional practice to use a grain dryer in two drying modes including a circulation drying mode and a continuous flow drying mode (see Patent Literature 1 referred hereinbelow).

The grain dryer described Patent Literature 1 includes a dryer main body having a storage section at an upper portion and a drying section at a lower portion, an intake duct provided at one side of the dryer main body to supply hot air into the drying section, and an exhaust duct provided at the other side of the dryer main body to discharge the hot air from the drying section.

The drying section includes a hot air channel and an exhaust air channel that are provided to extend horizontally between opposite side walls in the dryer main body. The hot air channel may be opened at one end facing the intake duct to supply hot air into the drying section. The exhaust air channel may be opened at the other end facing the exhaust duct to discharge the hot air into the exhaust duct. A set of plurality of horizontally juxtaposed hot air channels and exhaust air channels are arranged in a staggered fashion.

In the grain dryer, an blowing port of a hot air blower communicates with the intake duct, so that hot air from the blower is adapted to be supplied through the intake duct to the hot air channels, and the hot air is caused to flow out into an interior of the dryer main body to dry grains flowing down from a top to a bottom of the dryer main body.

The grain dryer includes a circulation conveyor provided on the outside the dryer main body to extend vertically, a horizontal conveyor provided below the dryer main body to establish a communication between a bottom portion of the dryer main body and a lower end of the circulation conveyor, and a circulation chute provided above the dryer main body to establish a communication between an upper end of the circulation conveyor and a loading port provided at an upper portion of the dryer main body.

The grain dryer can be used in a circulation drying mode by conveying grains displaced from the bottom portion to the upper portion of the dryer main body by the horizontal conveyor and the circulation conveyor to return the grains to the same grain dryer via the circulation chute.

The grin dryer may preferably be provided with a transfer chute configured to establish a communication between an exit of the circulation conveyor and a loading port of downstream adjacent grain dryer provided at an upper portion of a dryer main body.

The grain dryer can be used in a continuous flow drying mode by switching from the circulation chute to the transfer chute by a selector valve. In this continuous flow drying mode, grains conveyed is then transferred to the upper portion by the circulation conveyor to the adjacent grain dryer by way of the transfer chute without returning the grains to the upstream one.

In the above-mentioned grain dryer of prior art, although the storage section positioned at the upper portion of the dryer main body is adapted to be used for tempering (controlling the quality of) grains when the grain dryer is used in the circulation drying mode. However, when the grain dryer is used in the continuous flow drying mode, there is no need to temper grains so that there remained a problem that the storage section is not used effectively.

CITATION LIST

Patent Literature

[Patent Literature 1] Japanese Utility Model Registration No. 2559148

SUMMARY OF INVENTION

Technical Problem

Then, an object of the present invention is to provide a grain dryer capable of making effective use of the whole of a dryer main body whether the grain dryer is used in either a continuous flow drying mode or a circulation drying mode, and a method for using the grain dryer.

With a view to attaining the object, according to the present invention, there is provided a grain dryer comprising a dryer main body into which grains are loaded, a hot air chamber provided at one side of the dryer main body to supply hot air into an interior of the dryer main body and an exhaust air chamber provided at the other side of the dryer main body to discharge hot air from the interior of the dryer main body, grains loaded into the interior of the dryer main body being dried by hot air supplied from the hot air chamber, the hot air used to dry the grains being discharged from the exhaust air chamber, wherein the hot air chamber and the exhaust air chamber each have a plurality of upper and lower independent spaces, the corresponding spaces of the hot air chamber and the exhaust air chamber being disposed to be positioned substantially at the same height, and wherein the individual spaces of the hot air chamber communicate respectively with corresponding hot air generators to execute separate supplies of hot air generated by the hot air generators into the individual spaces, and a height range in the interior of the dryer main body into which hot air is supplied from the spaces of the hot air chamber is defined as a drying section to dry grains loaded into the interior of the dryer main body.

In the grain dryer according to the present invention, the hot air chamber and the exhaust air chamber each have the plurality of upper and lower independent spaces, and the corresponding spaces of the hot air chamber and the exhaust air chamber are disposed to be positioned substantially at the same height. Then, the individual spaces of the hot air chamber communicate with the corresponding hot air generators to execute the separate supplies of hot air generated by the hot air generators into the individual spaces, and the height range in the interior of the dryer main body into each of which hot air is supplied from each space of the hot air chamber is defined respectively as the drying section to dry grains loaded into the interior of the dryer main body. Thus, for example, in the case where hot air generated by the hot air generator is supplied into the lower space of the hot air chamber and a height range in the interior of the dryer main body into which hot air is supplied from the lower space of the hot air chamber is defined as the drying section, with the grain dryer being used in a circulation drying mode, a height range in the interior of the dryer main body into which hot air is to be supplied from the space of the hot air chamber other than the lower space thereof is defined as a storage section for tempering grains loaded in the dryer main body, thereby making it possible to make effective use of the whole of the grain dryer.

In addition, in the grain dryer according to the present invention, for example, in the case where hot air generated by the hot air generators is supplied into all the spaces of the hot air chamber, and a height range in the interior of the dryer main body into which hot air is supplied from all the spaces of the hot air chamber is defined as the drying section, with the grain dryer being used in a continuous flow drying mode, almost the whole of the height range within the interior of the dryer main body can be defined as the drying section to dry grains loaded into the dryer main body, thereby making it possible to make effective use of the whole of the dryer main body.

Further, in the grain dryer according to the present invention, for example, in the case where hot air generated by the hot air generator is supplied into the upper space of the hot air chamber, and a height range in the interior of the dryer main body into which hot air is supplied from the upper space of the hot air chamber is defined as the drying section, with the grain dryer being used in the continuous flow drying mode, a height range in the interior of the dryer main body into which hot air is to be supplied from the space of the hot air chamber other than the upper space thereof is defined as a cooling section for cooling grains loaded in the dryer main body when grains are subjected to finish drying, thereby making it possible to make effective use of the whole of the grain dryer.

In the grain dryer according to the present invention, preferably, the hot air chamber and the exhaust air chamber are both divided into two upper and lower compartments by partitions provided substantially at the same height positions within the individual chambers, allowing both the hot air chamber and the exhaust air chamber to have two upper and lower independent spaces.

In the grain dryer according to the present invention, preferably, hot air generated by the hot air generator is supplied to the lower space of the hot air chamber, and a height range in the interior of the dryer main body into which hot air is supplied from the lower space of the hot air chamber is defined as the drying section.

In the grain dryer according to the present invention, preferably, hot air generated by the hot air generators is supplied to all the spaces of the hot air chamber, and a height range in the interior of the dryer main body into which hot air is supplied from all the spaces of the hot air chamber is defined as the drying section.

In the grain dryer according to the present invention, preferably, hot air generated by the hot air generator is supplied to the upper space of the hot air chamber, and a height range in the interior of the dryer main body into which hot air is supplied from the upper space of the hot air chamber is defined as the drying section.

In the grain dryer according to the present invention, preferably, a hot air channel formed of a multiple aperture wall and opened at one end facing the hot air chamber and an exhaust air channel formed of a multiple aperture wall opened at the other end facing the exhaust air chamber are provided in the interior of the dryer main body, the hot air channel and the exhaust air channel being provided to extend horizontally between opposite side walls of the body, and with the hot air channel and the exhaust air channel forming a pair in an up-and-down direction, a plurality of the pairs of hot air channel and exhaust air channel are provided in a predetermined range in a height direction of the dryer main body, and each of the openings of the hot air channel and the exhaust air channel is provided with an opening and closing cover respectively, while a level sensor configured to detect a storage amount of grains is provided at an upper portion of each of the pairs of hot air channel and exhaust air channel, and the opening and closing covers are each controlled to be opened or closed based on results of detections of the level sensors to start drying grains loaded into the dryer main body sequentially from a lower portion of the dryer main body.

In the grain dryer according to the present invention, the hot air channel formed of the multiple aperture wall opened at one end facing the hot air chamber and the exhaust air channel formed of multiple aperture wall opened at the other end facing the exhaust air chamber are provided in the interior of the dryer main body, and the hot air channel and the exhaust air channel are provided to extend horizontally between opposite side walls of the body. Then, with the hot air channel and the exhaust air channel forming the pair in the up-and-down direction, the plurality of the pairs of hot air channel and exhaust air channel are provided over the predetermined range in the height direction of the dryer main body, and the opening and closing cover is provided at both the opening of the hot air channel and the opening of the exhaust air channel, while the level sensor configured to detect the storage amount of grains is provided at the upper portion of each of the pairs of hot air channel and exhaust air channel, and the opening and closing covers are each controlled to be opened or closed based on the results of the detections carried out by the level sensors to start drying grains loaded into the dryer main body sequentially from the lower portion of the dryer main body. Due to the configuration described above being adopted, the downtime can shorten to reduce loss of time, thereby making it possible to dry grains with good efficiency.

In addition, in the grain dryer according to the present invention, when grains are unloaded finally, in the case where the opening and closing covers are closed sequentially from the upper opening and closing covers of the hot air channels and the exhaust air channels from which grains have been discharged, with the grain dryer used in the continuous flow drying mode, a final circulation becomes unnecessary which is conventionally carried out to avoid the occurrence of uneven drying of grains.

In the grain dryer according to the present invention, preferably, a height range in the interior of the dryer main body into which hot air is supplied from the spaces of the hot air chamber is defined as a drying section, and a rotary valve provided at a bottom portion of the dryer main body is started to operate after the level sensor positioned at an uppermost portion of the drying section detects that grains are loaded in an entire space of the drying section to thereby start unloading the grains from the dryer main body.

In the grain dryer according to the present invention, the height range in the interior of the dryer main body into which hot air is supplied from the spaces of the hot air chamber is defined as the drying section, and the rotary valve provided at the bottom portion of the dryer main body is started to operate after the level sensor positioned at the uppermost portion of the drying section detects that grains are loaded in the entire space of the drying section to thereby start unloading the grains from the dryer main body. Thus, even when the grain dryer is used in either of the circulation drying mode and the continuous flow drying mode, the grain dryer can be operated with good efficiency. In addition, when the grain dryer is used in the continuous flow drying mode, an initial circulation operation becomes unnecessary which is conventionally carried out to avoid the occurrence of uneven drying of grains.

In the grain dryer according to the present invention, preferably, a first moisture meter configured to measure a moisture level of grains loaded into the dryer main body is provided before a loading port provided at an upper portion of the dryer main body, while a second moisture meter configured to measure a moisture level of grains unloaded from the dryer main body is provided after the rotary valve provided at the bottom portion of the dryer main body, and an operation speed of the rotary valve is controlled based on results of measurements by the first and second moisture meters to control a displacement of grains from the dryer main body, to thereby control a drying level of grains in the interior of the dryer main body.

In the grain dryer according to the present invention, the first moisture meter configured to measure a moisture level of grains loaded into the dryer main body is provided before the loading port provided at the upper portion of the dryer main body, while the second moisture meter configured to measure a moisture level of grains unloaded from the dryer main body is provided after the rotary valve provided at the bottom portion of the dryer main body, and the operation speed of the rotary valve is controlled based on the results of the measurements by the first and second moisture meters to control the unloading amount or displacement of grains from the dryer main body, to thereby control the drying level of grains in the interior of the dryer main body. Thus, since the operation time of the rotary valve can automatically be controlled without involvement of an operator, the work load can be reduced.

In addition, with a view to attaining the object, according to the present invention, there is provided a method for using the grain dryer in a circulation drying mode, wherein hot air generated by the hot air generator is supplied to the lower space of the hot air chamber, and a height range in the interior of the dryer main body into which hot air is supplied from the lower space of the hot air chamber is defined as the drying section to dry grains loaded into the dryer main body, while a height range in the interior of the dryer main body into which hot air is to be supplied from the space of the hot air chamber other than the lower space thereof is defined as a storage section for tempering grains loaded into the dryer main body.

In the method for using the grain dryer, hot air generated by the hot air generator is supplied to the lower space of the hot air chamber, and the height range in the interior of the dryer main body into which hot air is supplied from the lower space of the hot air chamber is defined as the drying section to dry grains loaded into the dryer main body, while the height range in the interior of the dryer main body into which hot air is to be supplied from the space of the hot air chamber other than the lower space thereof is defined as a storage section for tempering grains loaded into the dryer main body. Thus, when the grain dryer is used in the circulation drying mode, the whole of the dryer main body can be made effective use of as the dryer main body including the storage section at the upper portion and the drying section at the lower portion thereof.

According to the present invention, there is provided another method for using the grain dryer in a continuous flow drying mode, wherein hot air generated by the hot air generators is supplied to all the spaces of the hot air chamber, and a height range in the interior of the dryer main body into which hot air is supplied from all the spaces of the hot air chamber is defined as the drying section to dry grains loaded into the dryer main body.

In the method for using the grain dryer, hot air generated by the hot air generators is supplied to all the spaces of the hot air chamber, and the height range in the interior of the dryer main body into which hot air is supplied from all the spaces of the hot air chamber is defined as the drying section to dry grains loaded into the dryer main body. Thus, when the grain dryer is used in the continuous flow drying mode, the whole of the grain dryer main body can be made effective use of by using substantially the whole of the height range in the interior of the dryer main body as the drying section.

According to the present invention, there is provided a further method for using the grain dryer in a continuous flow drying mode, wherein hot air generated by the hot air generator is supplied to the upper space of the hot air chamber, and a height range in the interior of the dryer main body into which hot air is supplied from the upper space of the hot air chamber is defined as the drying section to dry grains loaded into the dryer main body, while a height range in the interior of the dryer main body into which hot air is to be supplied from the space of the hot air chamber other than the upper space thereof is defined as a cooling section for cooling grains when finish drying is executed.

In the method for drying grains by the grain dryer, hot air generated by the hot air generator is supplied to the upper space of the hot air chamber, and the height range in the interior of the dryer main body into which hot air is supplied from the upper space of the hot air chamber is defined as the drying section to dry grains loaded into the dryer main body, while the height range in the interior of the dryer main body into which hot air is to be supplied from the space of the hot air chamber other than the upper space thereof is defined as the cooling section for cooling grains when finish drying is executed. Thus, when the grain dryer is used in the continuous flow drying mode, the whole of the dryer main body can be made effective use of as the dryer main body including the drying section at the upper portion and the cooling section at the lower portion thereof.

Advantageous Effect of Invention

According to the present invention, the grain dryer enabling the whole of the dryer main body to be made effective use of and the method for using the grain dryer can be provided whether the grain dryer is used in either the continuous flow drying mode or the circulation drying mode.

DESCRIPTION OF EMBODIMENT

An embodiment of the present invention will now be described with reference to the attached drawings.

Figure 1:
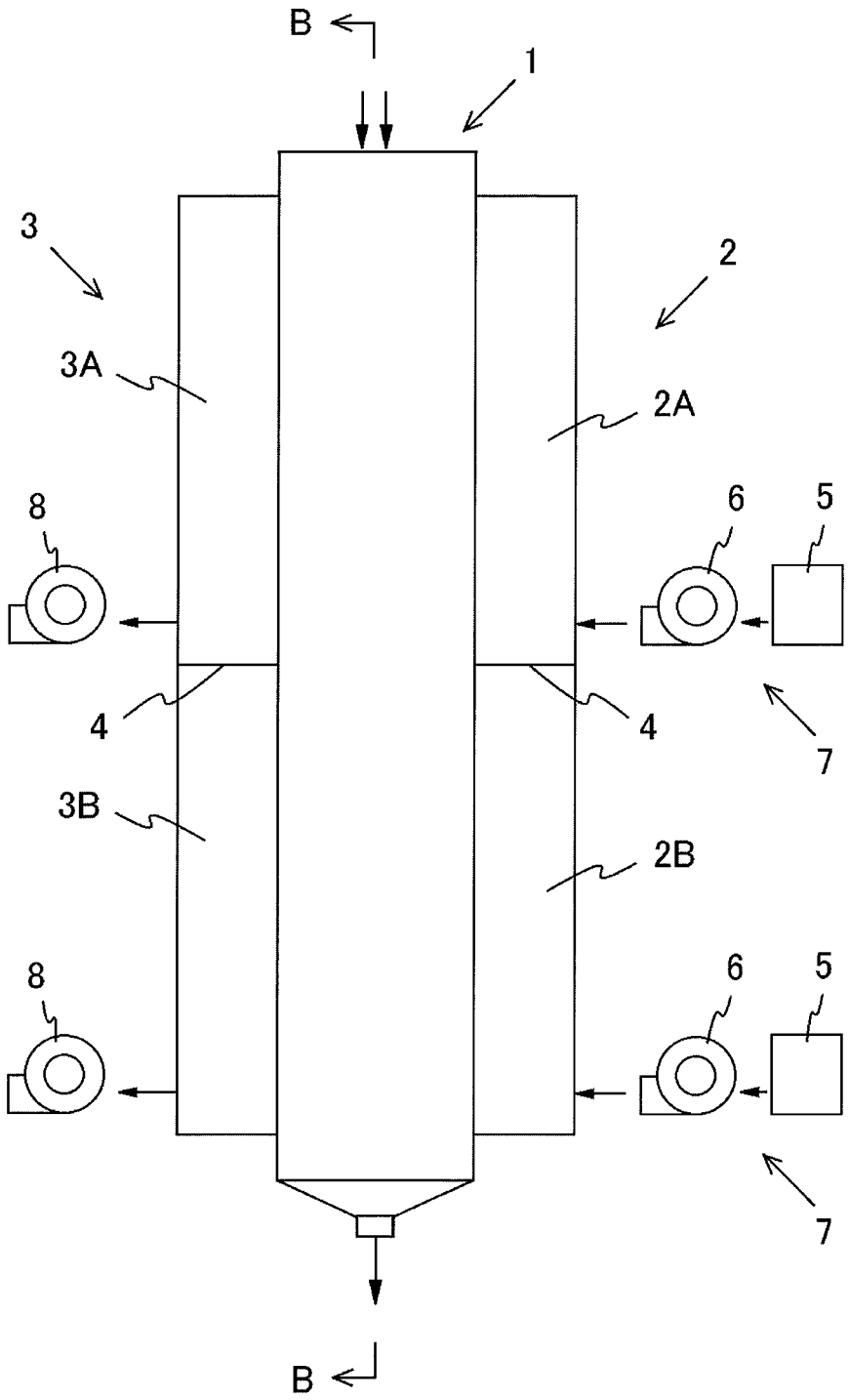
FIG. 1 is a schematic front view of a grain dryer according to an embodiment of the present invention.
Figure 2:
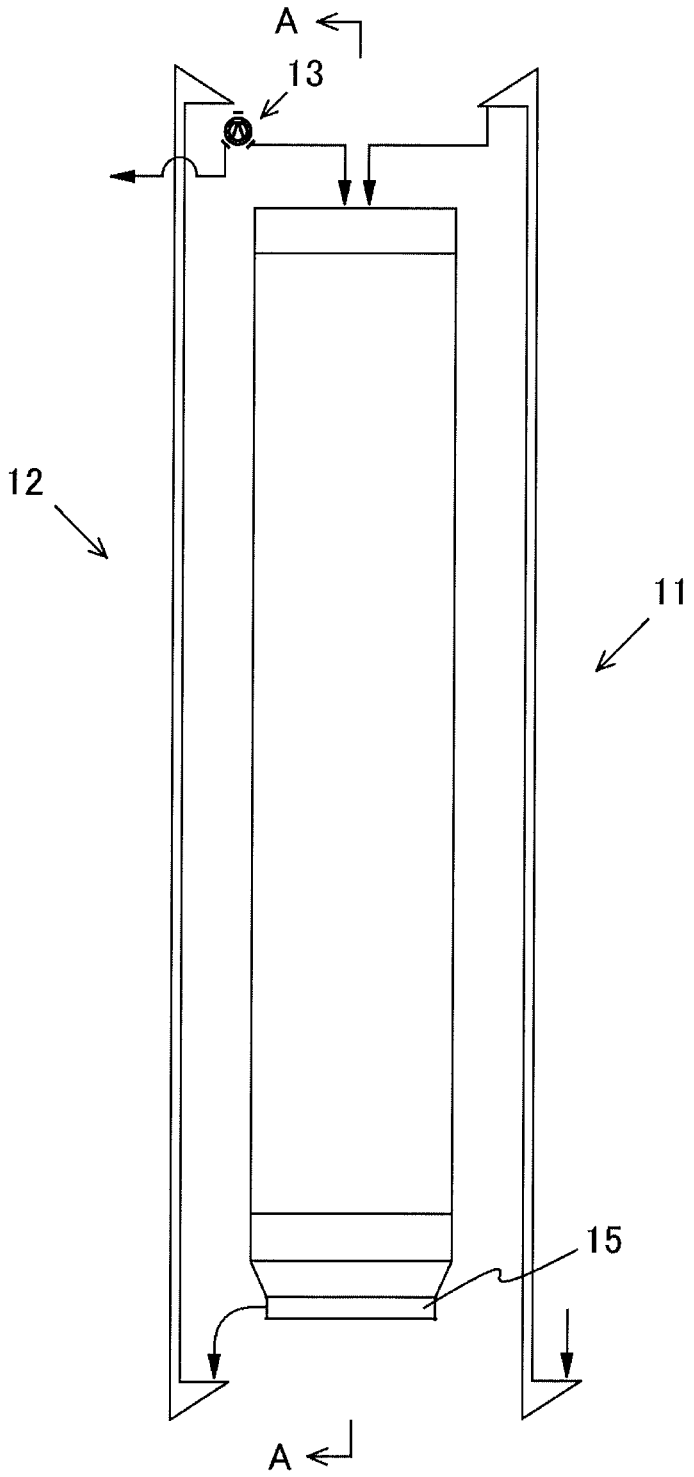
FIG. 2 is a schematic side view of the grain dryer illustrated in FIG. 1.

FIG. 1 illustrates a schematic front view of a grain dryer according to an embodiment of the present invention. FIG. 2 is a schematic side view of the grain dryer illustrated in FIG. 1.

A grain dryer of this embodiment of the present invention includes a dryer main body 1, a hot air chamber 2 provided at one side of the dryer main body 1 to supply hot air into an interior of the dryer main body 1, and an exhaust air chamber 3 provided at the other side of the dryer main body 1 to exhaust the hot air from the interior of the dryer main body 1.

The hot air chamber 2 and the exhaust air chamber 3 are both divided into two upper and lower compartment by a partition wall 4 and hence both compartments have their own two upper and lower independent spaces. Then, an upper hot air chamber 2A and an upper exhaust air chamber 3A are disposed so that spaces defined therein are positioned substantially at the same height, and a lower hot air chamber 2B and a lower exhaust air chamber 3B are disposed so that spaces defined therein are positioned substantially at the same height.

The grain dryer includes two sets of burner and fan units 7, 7 each made up of a burner 5 as a hot air generator and an intake blower 6 configured to supply hot air generated by the hot air generator 5 to the hot air chamber 2.

The spaces of the upper and lower hot air chambers 2A, 2B communicate with the corresponding burner and fan units 7, 7, whereby hot air generated by the hot air generators 5 is supplied separately or independently into the corresponding spaces.

The grain dryer is further provided with two exhaust blowers 8, 8.

The spaces defined by the upper and lower exhaust air chambers 3A, 3B communicate respectively with the corresponding exhaust blowers 8, 8, and the hot air is adapted to be discharged from the spaces to an exterior of the grain dryer by the action of the exhaust blowers 8, 8.

The grain dryer of this embodiment of the present invention includes further a loading lift 11 and a circulation/unloading lift 12. These lifts are provided along the outer sides of the dryer main body 1 to extend vertically. An exit side of the circulation/unloading lift 12 is provided with a selector valve 13.

The loading lift 11 is a device for lifting up raw grain and loading them into the dryer main body 1 through a loading port provided at an upper portion thereof. The raw grain loaded into the dryer main body 1 is distributed or scattered uniformly by a diffuser, not shown.

The circulation/unloading lift 12 is adapted to lift up grain conveyed by a horizontal conveyor 15 provided below the dryer main body 1 and loads them through the loading port into the dryer main body 1 for circulation by switching over the selector valve 13. The grain loaded into the dryer main body 1 is distributed or scattered uniformly by the diffuser, not shown.

In addition, the circulation/unloading lift 12 is adapted to lift up grain conveyed by the horizontal conveyor 15 provided below the dryer main body 1 and unloads the grain to the following process such as a storage tank or the like, not shown, by switching over the selector valve 13.

Figure 3:
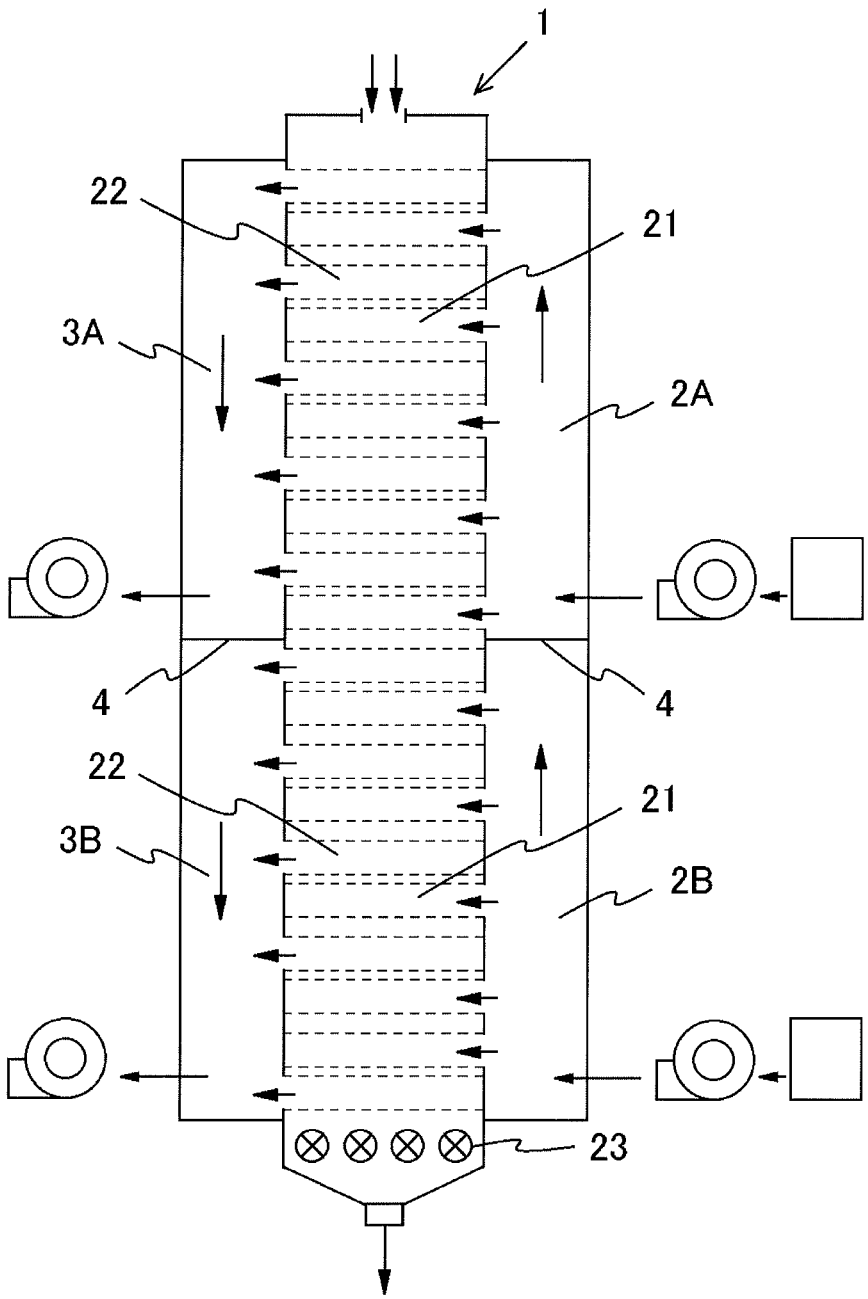
FIG. 3 is a schematic front sectional view of the grain dryer taken along a line A-A in FIG. 2.
Figure 4:
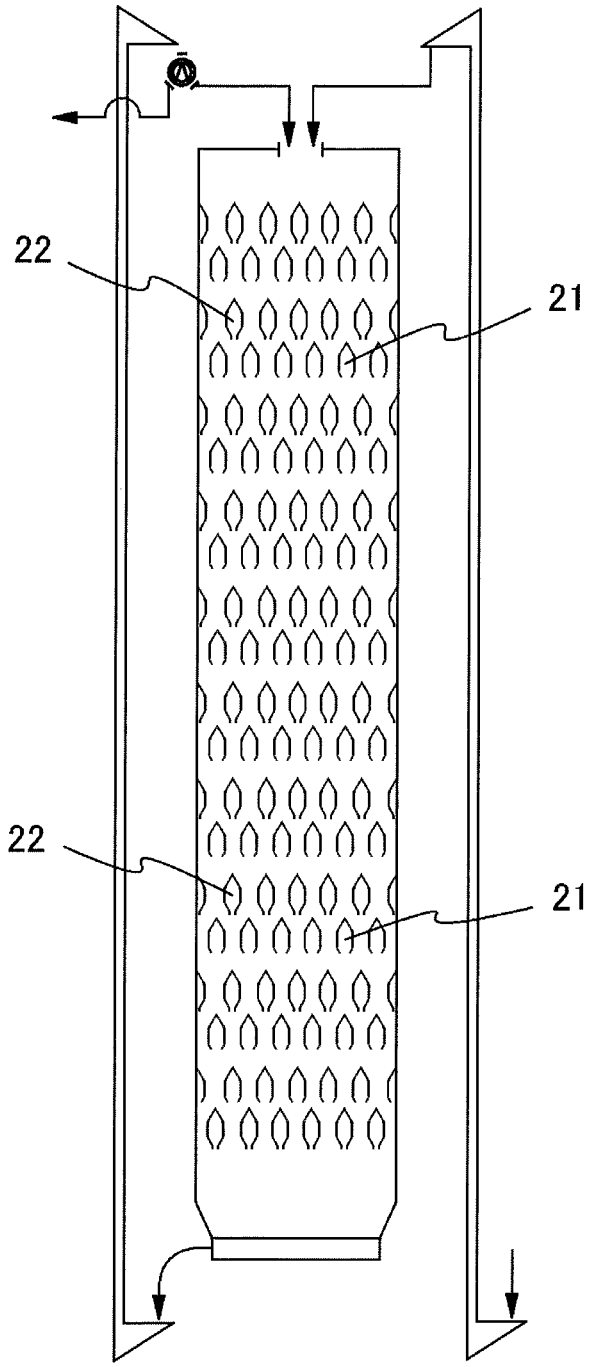
FIG. 4 is a schematic side sectional view of the grain dryer taken along a line B-B in FIG. 1.

FIG. 3 illustrates a schematic front sectional view of the grain dryer taken along a line A-A in FIG. 2. FIG. 4 illustrates a schematic side sectional view of the grain dryer taken along a line B-B in FIG. 1.

In an interior of the dryer main body 1, the grain dryer includes hot air channels 21 (a hot air louvers) opened at one end facing the hot air chamber 2 and configured to take in the hot air supplied from the hot air chamber 2 and exhaust air channels 22 (an exhaust air louvers) opened at the other end facing the exhaust air chamber 3 and configured to exhaust or discharge the hot air into the exhaust air chamber 3, the hot air channels 21 and the exhaust air channel 22*s* being provided to extend horizontally between opposite side walls of the dryer main body 1.

Each of the hot air channels 21 and the exhaust air channels 22 includes an air path having an angle shape in a vertical section, and an upper surface and side surfaces thereof are formed of a multiple aperture wall, while a lower surface is opened into a slit shape.

Additionally, a plurality of laterally aligned hot air channels 21 and a plurality of laterally aligned exhaust air channels 22 form a pair in an up-and-down direction. The plurality of channels included in the pair are disposed in a staggered fashion.

Here, an example is illustrated in which 10 pairs of hot air channels 21 and exhaust air channels 22 are provided in a substantially whole range in a height direction in the interior of the dryer main body 1.

Then, a plurality of rotary valves 23 are provided at a bottom portion in the interior of the dryer main body 1, and the grain loaded in the dryer main body 1 is unloaded therefrom by the turning operation of the rotary valves 23.

Hot air generated by the hot air generators 5, 5 is supplied into the respective spaces of the upper and lower hot air chamber 2A, 2B by the corresponding intake blowers 6, 6. Hot air supplied into those spaces is supplied into the interior of the dryer main body 1 through the hot air channels 21 provided in the height range of the dryer main body 1 where the upper and lower spaces are located to dry grain in the interior of the dryer main body 1. Then, the hot air used to dry the grain is discharged into the respective spaces of the upper and lower exhaust air chambers 3A, 3B through the exhaust air channels 22 and then discharged to an exterior of the grain dryer by the action of the corresponding exhaust blowers 8, 8.

In the grain dryer according to this embodiment of the present invention, only the lower burner and fan unit 7 can be operated, so that hot air generated by the corresponding hot air generator 5 is supplied only into the space of the lower hot air chamber 2B. By doing so, the height range of the dryer main body 1 where the space of the lower hot air chamber 2B is located, that is, a lower half portion of the dryer main body 1 is allowed to function as a drying section to dry grain loaded into the interior of the dryer main body 1.

Additionally, in the grain dryer according to this embodiment of the present invention, both of the upper and lower burner and fan units 7, 7 can be operated, so that hot air generated by both the hot air generators 5, 5 is supplied into both the spaces of the upper and the lower hot air chambers 2A, 2B. By doing so, the height range of the dryer main body 1 where both the spaces of the hot air chamber 2 are located, that is, substantially the whole range of the dryer main body 1 is allowed to function as a drying section to dry grain loaded into the interior of the dryer main body 1.

Further, in the grain dryer according to this embodiment of the present invention, only the upper burner and fan unit 7 can be operated, so that hot air generated by the corresponding hot air generator 5 is supplied only into the space of the upper hot air chamber 2A. By doing so, the height range of the dryer main body 1 where the space of the upper hot air chamber 2A is located, that is, an upper half portion of the dryer main body 1 is allowed to function as a drying section to dry grain loaded into the interior of the dryer main body 1.

A method for using the grain dryer according the embodiment of the present invention will now be described by taking one example.

Figure 5:
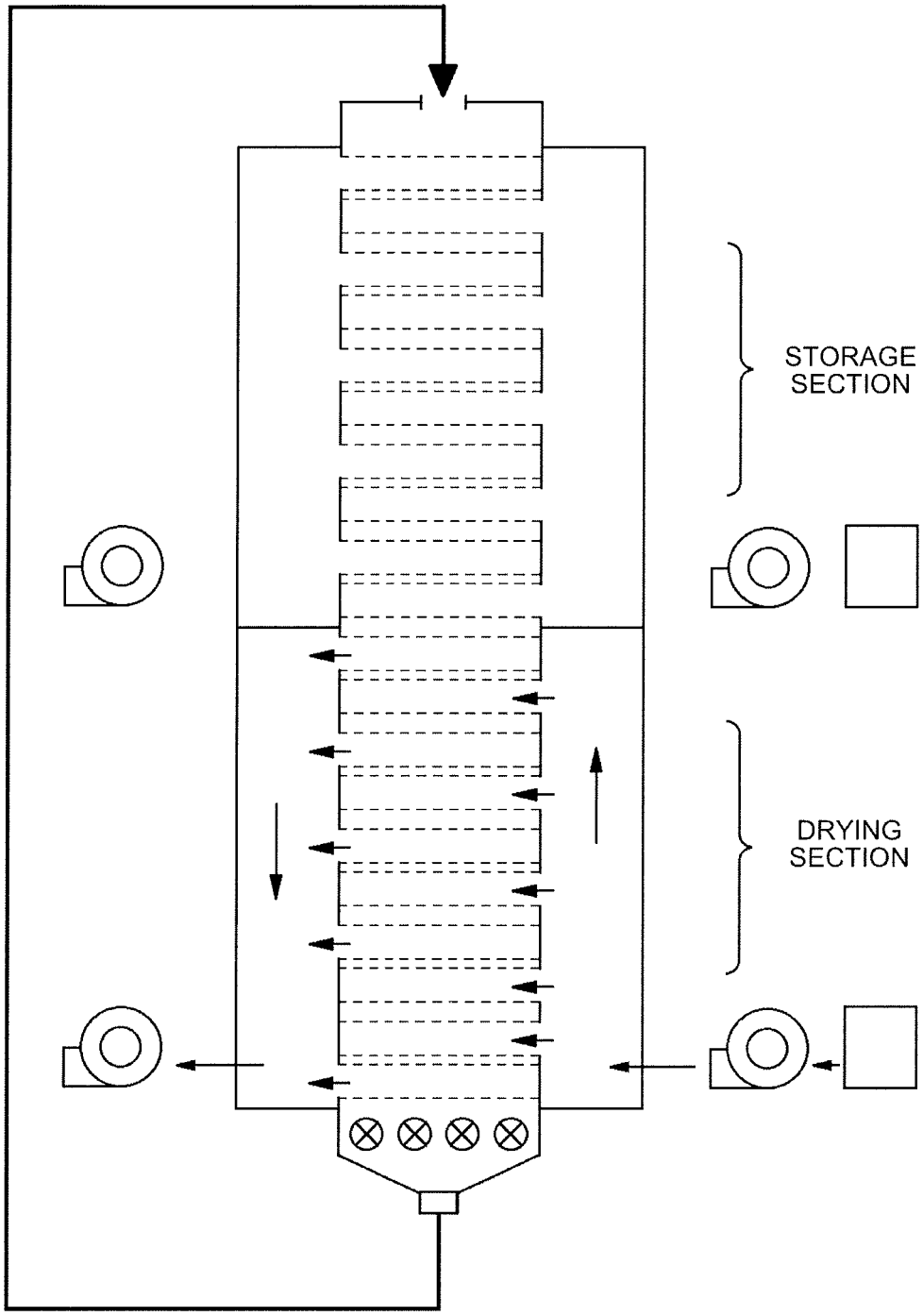
FIG. 5 is an explanatory diagram when the grain dryer in FIG. 1 is used in a circulation drying mode.

FIG. 5 illustrates an explanatory diagram when the grain dryer according to the embodiment of the present invention is used in a circulation drying mode.

When the grain dryer is used in the circulation drying mode, the lower burner and fan unit 7 is operated to supply hot air generated by the corresponding hot air generator 5 only into the space of the lower hot air chamber 2B, whereby the lower half portion of the dryer main body 1 is caused to function as a drying section, while the upper half portion of the dryer main body 1 where the space of the upper hot air chamber 2A is located is used as a storage section.

By adopting this configuration, when the grain dryer is used in the circulation drying mode, grain can be tempered in the storage section defined in the upper half portion of the dryer main body 1.

Figure 6:
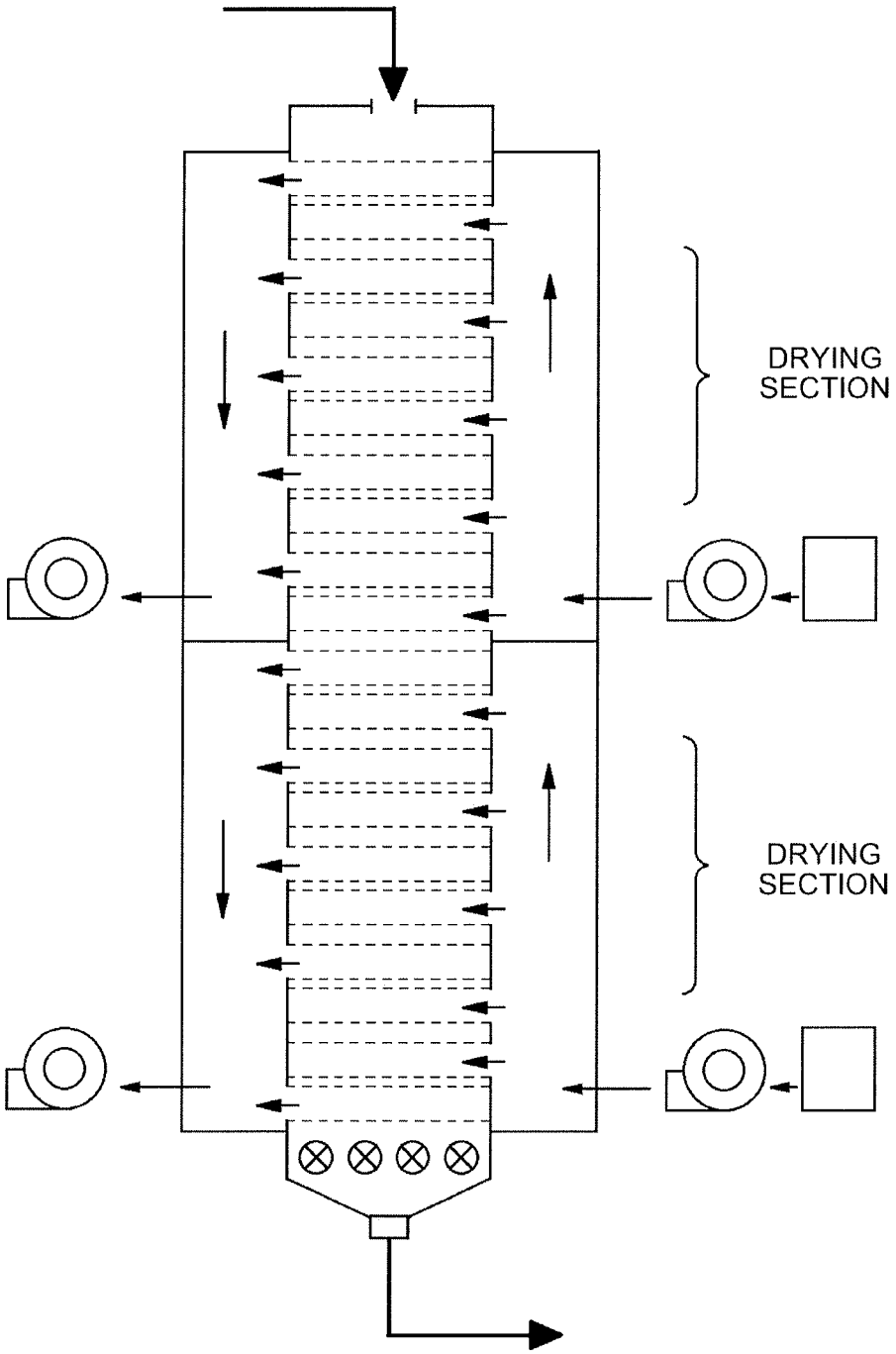
FIG. 6 is an explanatory diagram when the grain dryer in FIG. 1 is used in a continuous flow drying mode.

FIG. 6 illustrates an explanatory diagram when the grain dryer is used in a continuous flow drying mode.

When the grain dryer is used in the continuous flow drying mode, both the upper and lower burner and fan units 7, 7 are operated to supply hot air generated by both the hot air generators 5, 5 into both the spaces of the upper and lower hot air chambers 2A, 2B, whereby substantially the whole of the dryer main body 1 is used as a drying section.

By adopting this configuration, when the grain dryer is used in the continuous flow drying mode, grain can be dried in the drying section defined in substantially the whole of the dryer main body 1.

Figure 7:
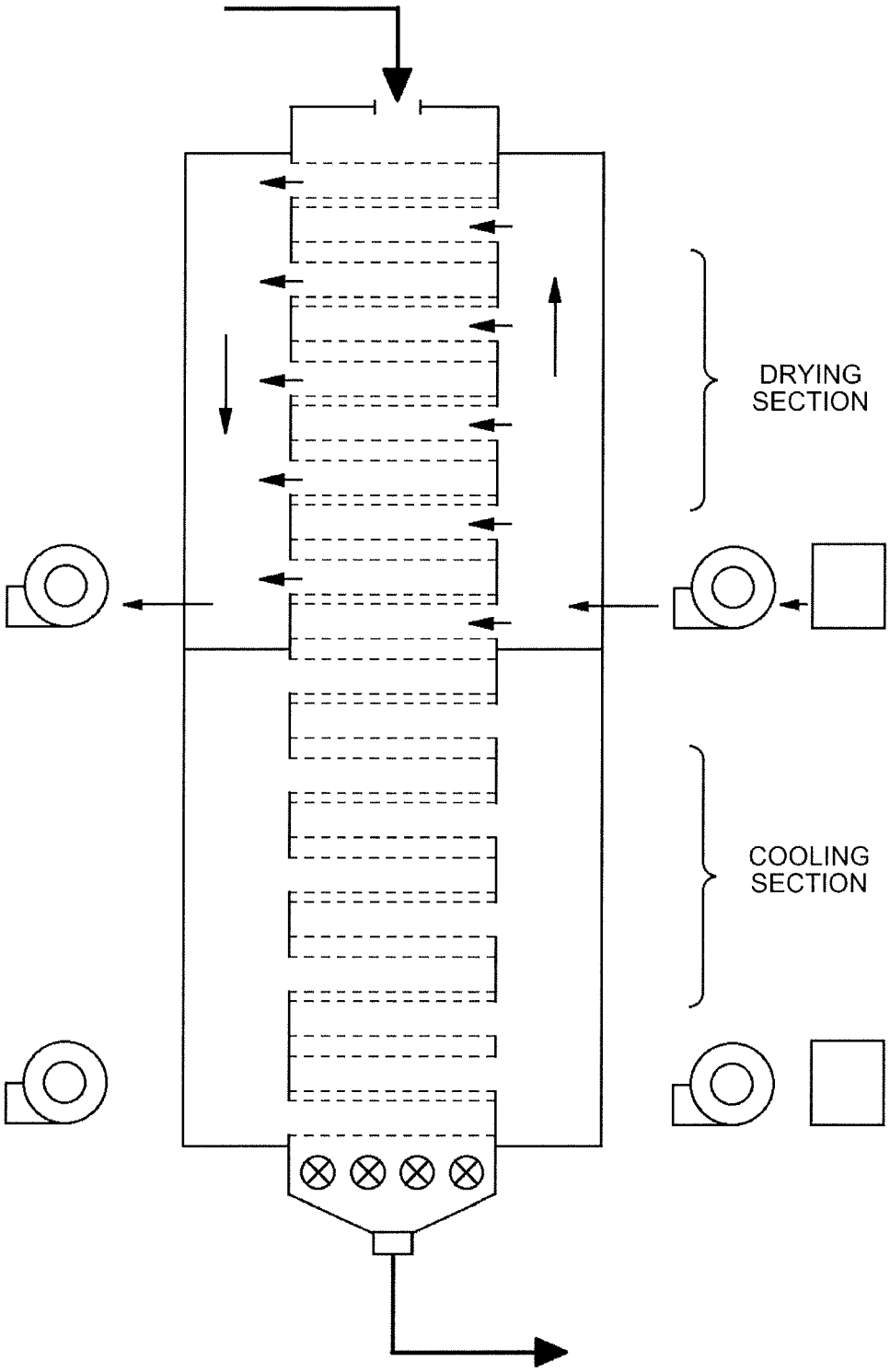
FIG. 7 is another explanatory diagram when the grain dryer in FIG. 1 is used in another continuous flow drying mode.

FIG. 7 illustrates an explanatory diagram when the grain dryer is used in another continuous flow drying mode.

When the grain dryer is used in this continuous flow drying mode, the upper burner and fan unit 7 is operated to supply hot air generated by the corresponding hot air generator 5 only into the space of the upper hot air chamber 2A, whereby the upper half portion of the dryer main body 1 is caused to function as a drying section, while the lower half portion of the dryer main body 1 where the space of the lower hot air chamber 2B is located is used as a cooling section.

By adopting this configuration, when the grain dryer is used in the continuous flow drying mode, grain can be cooled in the cooling section defined in the lower half portion of the dryer main body 1 when a finish drying is performed.

When the lower half portion of the dryer main body 1 is used as the cooling section, only the corresponding intake blower 6 is preferably operated to supply air.

In the grain dryer according to the embodiment of the present invention, opening and closing covers, not shown, can be provided at the openings of the hot air channels 21 and the openings of the exhaust air channels 22.

Additionally, level sensors, not shown, each configured to detect a storage amount of grain can be provided in upper positions of the pairs of hot air channel 21 and exhaust air channel 22.

In the grain dryer described above, when the opening and closing covers are controlled to be opened or closed based on the results of detections by the level sensors, raw grain loaded into the dryer main body 1 can be started to be dried sequentially from raw grain stored at a lower portion of the dryer main body 1.

Consequently, according to the grain dryer, the downtime can be reduced, whereby grain can be dried with good efficiency whether the grain dryer is used in either the circulation drying mode or the continuous flow drying mode.

In addition, according to the grain dryer described above, the opening and closing covers can be closed from the upper hot air channels and exhaust air channels from which grain has been discharged when grain is unloaded finally.

Consequently, according to the grain dryer, when the grain dryer is used in the continuous flow drying mode, a final circulation becomes unnecessary which is conventionally carried out to avoid uneven drying of grain.

In the grain dryer described above, the rotary valves 23 provided at the bottom portion of the dryer main body 1 can be started to be opened to start unloading of grain from the dryer main body 1 after the level sensor situated at the uppermost portion of the height range that is used as the drying section of the dryer main body 1 detects that grain has been loaded completely in the dryer main body 1.

Consequently, according to the grain dryer, the grain dryer can be operated with good efficiency whether the grain dryer is used in either the circulation drying mode or the continuous flow drying mode.

In addition, according to the grain dryer described above, when the grain dryer is used in the continuous flow drying mode, an initial circulation operation becomes unnecessary which is conventionally carried out to avoid uneven drying of grain.

In the grain dryer according to this embodiment of the present invention, a first moisture meter, not shown, configured to measure a moisture level of grain to be loaded into the dryer main body 1 can be provided before the loading port 7 of the upper portion of the dryer main body 1 and near the exit of the circulation/unloading lift 12.

Additionally, in the grain dryer according to the embodiment of the present invention, a second moisture meter, not shown, configured to measure a moisture level of grain unloaded from the dryer main body 1 can be provided after the rotary valves 23 at the bottom portion of the dryer main body 1 and near an entrance to the circulation/unloading lift 12.

In the grain dryer, a drying level of grain in the interior of the dryer main body 1 can be adjusted by controlling the operation speed of the rotary valves 23 on the basis of the results of measurements obtained from the first and second moisture meters to control a displacement of grain from the dryer main body 1.

Consequently, the operation time of the rotary valves 23 can automatically be controlled without involvement of an operator, thereby making it possible to reduce the work load of the operator.

In the embodiment of the present invention, the hot air chamber 2 and the exhaust air chamber 3 are both divided into the two upper and lower compartments by the partition wall 4 to define the two upper and lower independent spaces. Nevertheless, the hot air chamber 2 and the exhaust air chamber 3 can also be configured to have vertically aligned and positioned three or more independent spaces.

In the embodiment of the present invention, the upper and lower hot air chambers 2A, 2B, and the upper and lower exhaust air chambers 3A, 3B are both formed by dividing the one air chamber into the two upper and lower compartments by the partition wall 4. However, these compartments can also be formed by providing vertically aligned and positioned two independent compartments.

In the embodiment of the present invention, a plurality of juxtaposed hot air channels 21 are disposed vertically in staggered fashion with respect to and a plurality of juxtaposed exhaust air channels 22 in pair. The vertically staggered pairs of the hot air channels 21 and the exhaust channels 22 may be disposed between side walls of predetermined height to form a dryer unit of rectangular cross-section. The dryer main body 1 can easily be built up by stacking up a plurality of such dryer compartment units.

In the embodiment of the present invention, the grain dryer is described as including the two burner and fan units 7; however, the grain dryer can also be configured to include only one burner and fan unit. In this case, with the one burner and fan unit 7 caused to communicate with both the spaces of the upper and lower hot air chambers 2A, 2B, the burner and fan unit 7 should be controlled so that hot air can be supplied into both spaces at the same time or can be supplied only into either of both the spaces.

In the embodiment of the present invention, the grain dryer is described so that hot air is supplied into the interior of the dryer main body 1 by the blower 6 of the burner and fan unit 7 and hot air is discharged from the interior of the dryer main body 1 by the exhaust blower 8. However, with the exhaust blower 8 eliminated, hot air can be supplied into the interior of the dryer main body 1 and can be discharged from the interior of the dyer main body 1 only by the air intake action of the intake blower 6. Additionally, with the intake blower 6 eliminated, hot air can be supplied into the interior of the dryer main body 1 and can be discharged from the interior of the dyer main body 1 only by the air sucking action of the exhaust blower 8.

Note that the present invention is not limited to the embodiment that has been described heretofore, and hence, although needless to say, the configuration of the present invention can be altered or modified as required without departing from the spirit and scope of the present invention.

INDUSTRIAL APPLICABILITY

The grain dryer of the present invention is such that the whole of the dryer main body can be made effective use of whether the grain dryer is used in either the circulation drying mode or the continuous flow drying mode, and therefore, its practical value is extremely high.

REFERENCE SIGNS LIST

1 Dryer main body
2 Hot air chamber
2A Upper hot air compartment
2B Lower hot air compartment
3 Exhaust air chamber
3A Upper exhaust air compartment
3B Lower exhaust air compartment
4 Partition wall
5 Hot air generator (Burner)
6 Intake blower
7 Burner and fan unit
8 Exhaust blower
11 Loading lift
12 Circulation/unloading lift
13 Selector valve
15 Horizontal conveyor
21 Hot air channel (Hot air louver)
22 Exhaust air channel (Exhaust air louver)
23 Rotary valve

The invention claimed is:

1. A grain dryer comprising:

a dryer main body into which grains are loaded;

a hot air chamber provided at one side of the dryer main body to supply hot air into an interior of the dryer main body; and an exhaust air chamber provided at a second side opposite the one side of the dryer main body to discharge hot air from the interior of the dryer main body, grains loaded into the interior of the dryer main body being dried by hot air supplied from the hot air chamber, the hot air used to dry the grains being discharged from the exhaust air chamber, wherein the hot air chamber and the exhaust air chamber each have a plurality of corresponding upper and lower independent spaces, the upper and lower independent spaces of the hot air chamber being disposed to be positioned substantially at a same height as the corresponding upper and lower independent spaces of the exhaust air chamber, and wherein the independent spaces of the hot air chamber communicate respectively with corresponding hot air generators to execute separate supplies of hot air generated by the hot air generators into the independent spaces, and a height range in the interior of the dryer main body into which hot air is supplied from the spaces of the hot air chamber is defined as a drying section to dry grains loaded into the interior of the dryer main body.

2. The grain dryer according to claim 1, wherein the hot air chamber and the exhaust air chamber are both divided into two upper and lower compartments by partitions provided substantially at same height positions within the individual chambers, allowing both the hot air chamber and the exhaust air chamber to have two upper and lower independent spaces.

3. The grain dryer according to claim 1, wherein hot air generated by the hot air generators is supplied to the lower independent spaces of the hot air chamber, and a height range in the interior of the dryer main body into which hot air is supplied from the lower independent spaces of the hot air chamber is defined as the drying section.

4. The grain dryer according to claim 1, wherein hot air generated by the hot air generators is supplied to all the spaces of the hot air chamber, and a height range in the interior of the dryer main body into which hot air is supplied from all the spaces of the hot air chamber is defined as the drying section.

5. The grain dryer according to claim 1, wherein hot air generated by the hot air generators is supplied to the upper independent spaces of the hot air chamber, and a height range in the interior of the dryer main body into which hot air is supplied from the upper independent spaces of the hot air chamber is defined as the drying section.

6. The grain dryer according claim 1, wherein a hot air channel formed of a multiple aperture wall and opened at a first end facing the hot air chamber and an exhaust air channel formed of a multiple aperture wall opened at a second end facing the exhaust air chamber are provided in the interior of the dryer main body, the hot air channel and the exhaust air channel being provided to extend horizontally between opposite side walls of the body, and with the hot air channel and the exhaust air channel forming a pair in an up-and-down direction, a plurality of pairs of hot air channel and exhaust air channel are provided in a predetermined range in a height direction of the dryer main body, wherein each opening of the hot air channel and each opening of the exhaust air channel is provided with an opening and closing cover, while a level sensor configured to detect a storage amount of grains is provided at an upper portion of each of the pairs of hot air channel and exhaust air channel, and wherein the opening and closing covers are each controlled to be opened or closed based on results of detections of the level sensors to start drying grains loaded into the dryer main body sequentially from a lower portion of the dryer main body.

7. The grain dryer according to claim 6, wherein a height range in the interior of the dryer main body into which hot air is supplied from the spaces of the hot air chamber is defined as a drying section, and a rotary valve provided at a bottom portion of the dryer main body is started to operate after the level sensor positioned at an uppermost portion of the drying section detects that grains are loaded in an entire space of the drying section to thereby start unloading the grains from the dryer main body.

8. The grain dryer according to claim 1, comprising:

a rotary valve provided at a bottom portion of the dryer main body, wherein the rotary valve is started to unload the grains from the dryer main body, wherein a first moisture meter configured to measure a moisture level of grains loaded into the dryer main body is provided before a loading port provided at an upper portion of the dryer main body, while a second moisture meter configured to measure a moisture level of grains unloaded from the dryer main body is provided after the rotary valve provided at the bottom portion of the dryer main body, and an operation speed of the rotary valve is controlled based on results of measurements by the first moisture meter and the second moisture meter to control a displacement of grains from the dryer main body, to thereby control a drying level of grains in the interior of the dryer main body.

9. A method for using a grain dryer in a circulation drying mode, comprising:

loading grains into a dryer main body, the dryer main body including a hot air chamber provided at one side of the dryer main body to supply hot air into an interior of the dryer main body and an exhaust air chamber provided at a second side opposite the one side of the dryer main body to discharge hot air from an interior of the dryer main body, wherein the hot air chamber and the exhaust air chamber each have a plurality of corresponding upper and lower independent spaces, the upper and lower independent spaces of the hot air chamber positioned substantially at a same height as the corresponding upper and lower independent spaces of the exhaust air chamber, and wherein the independent spaces of the hot air chamber communicate respectively with corresponding hot air generators to execute separate supplies of hot air generated by the hot air generators into the independent spaces;

generating hot air by the hot air generators;

supplying the hot air to the lower independent spaces of the hot air chamber, wherein a height range in the interior of the dryer main body into which hot air is supplied from the lower independent spaces of the hot air chamber is defined as a drying section;

drying the grains loaded into the dryer main body by the hot air generated by the hot air generators and supplied from the hot air chamber, the hot air used to dry the grains being discharged from the exhaust air chamber, wherein a height range in the interior of the dryer main body into which hot air is supplied from a space of the hot air chamber other than the lower independent spaces thereof is defined as a storage section; and tempering the grains loaded into the dryer main body in the storage section.

10. A method for using a grain dryer in a continuous flow drying mode, comprising:

loading grains into a dryer main body, the dryer main body including a hot air chamber provided at one side of the dryer main body to supply hot air into an interior of the dryer main body and an exhaust air chamber provided at a second side opposite the one side of the dryer main body to discharge hot air from an interior of the dryer main body, wherein the hot air chamber and the exhaust air chamber each have a plurality of corresponding upper and lower independent spaces, the upper and lower independent spaces of the hot air chamber positioned substantially at a same height as the corresponding upper and lower independent spaces of the exhaust air chamber, and wherein the independent spaces of the hot air chamber communicate respectively with corresponding hot air generators to execute separate supplies of hot air generated by the hot air generators into the independent spaces;

generating hot air by the hot air generators;

supplying the hot air to all the spaces of the hot air chamber, wherein a height range in the interior of the dryer main body into which hot air is supplied from all the spaces of the hot air chamber is defined as a drying section; and drying the grains loaded into the dryer main body by hot air supplied from the hot air chamber, the hot air used to dry the grains being discharged from the exhaust air chamber.

11. A method for using a grain dryer in a continuous flow drying mode, comprising:

loading grains into a dryer main body, the dryer main body including a hot air chamber provided at one side of the dryer main body to supply hot air into an interior of the dryer main body and an exhaust air chamber provided at a second side opposite the one side of the dryer main body to discharge hot air from an interior of the dryer main body, wherein the hot air chamber and the exhaust air chamber each have a plurality of corresponding upper and lower independent spaces, the upper and lower independent spaces of the hot air chamber positioned substantially at a same height as the corresponding upper and lower independent spaces of the exhaust air chamber, and wherein the independent spaces of the hot air chamber communicate respectively with corresponding hot air generators to execute separate supplies of hot air generated by the hot air generators into the independent spaces;

generating hot air by the hot air generators;

supplying the hot air to the upper independent spaces of the hot air chamber, wherein a height range in the interior of the dryer main body into which hot air is supplied from the upper independent spaces of the hot air chamber is defined as a drying section;

drying the grains loaded into the dryer main body by the hot air generated by the hot air generators, wherein a height range in the interior of the dryer main body into which hot air is to be supplied from a space of the hot air chamber other than the upper independent spaces thereof is defined as a cooling section; and cooling the grains when finish drying is executed.

12. The grain dryer according to claim 2, wherein hot air generated by the hot air generators is supplied to the lower independent spaces of the hot air chamber, and a height range in the interior of the dryer main body into which hot air is supplied from the lower independent spaces of the hot air chamber is defined as the drying section.

13. The grain dryer according to claim 2, wherein hot air generated by the hot air generators is supplied to all the spaces of the hot air chamber, and a height range in the interior of the dryer main body into which hot air is supplied from all the spaces of the hot air chamber is defined as the drying section.

14. The grain dryer according to claim 2, wherein hot air generated by the hot air generators is supplied to the upper independent spaces of the hot air chamber, and a height range in the interior of the dryer main body into which hot air is supplied from the upper independent spaces of the hot air chamber is defined as the drying section.

15. The grain dryer according to claim 2, wherein a hot air channel formed of a multiple aperture wall and opened at a first end facing the hot air chamber and an exhaust air channel formed of a multiple aperture wall opened at a second end facing the exhaust air chamber are provided in the interior of the dryer main body, the hot air channel and the exhaust air channel being provided to extend horizontally between opposite side walls of the body, and with the hot air channel and the exhaust air channel forming a pair in an up-and-down direction, a plurality of pairs of hot air channel and exhaust air channel are provided in a predetermined range in a height direction of the dryer main body, wherein each opening of the hot air channel and each opening of the exhaust air channel is provided with an opening and closing cover, while a level sensor configured to detect a storage amount of grains is provided at an upper portion of each of the pairs of hot air channel and exhaust air channel, and wherein the opening and closing covers are each controlled to be opened or closed based on results of detections of the level sensors to start drying grains loaded into the dryer main body sequentially from a lower portion of the dryer main body.

16. The grain dryer according to claim 2, comprising:

a rotary valve provided at a bottom portion of the dryer main body, wherein the rotary valve is started to unload the grains from the dryer main body, wherein a first moisture meter configured to measure a moisture level of grains loaded into the dryer main body is provided before a loading port provided at an upper portion of the dryer main body, while a second moisture meter configured to measure a moisture level of grains unloaded from the dryer main body is provided after the rotary valve provided at the bottom portion of the dryer main body, and an operation speed of the rotary valve is controlled based on results of measurements by the first moisture meter and the second moisture meter to control a displacement of grains from the dryer main body, to thereby control a drying level of grains in the interior of the dryer main body.

17. The method for using the grain dryer in a circulation drying mode according to claim 9, wherein the hot air chamber and the exhaust air chamber are both divided into two upper and lower compartments by partitions provided substantially at same height positions within the individual chambers, allowing both the hot air chamber and the exhaust air chamber to have two upper and lower independent spaces.

18. The method for using the grain dryer in a continuous flow drying mode according to claim 10, wherein the hot air chamber and the exhaust air chamber are both divided into two upper and lower compartments by partitions provided substantially at same height positions within the individual chambers, allowing both the hot air chamber and the exhaust air chamber to have two upper and lower independent spaces.

19. The method for using the grain dryer in a continuous flow drying mode according to claim 11, wherein the hot air chamber and the exhaust air chamber are both divided into two upper and lower compartments by partitions provided substantially at same height positions within the individual chambers, allowing both the hot air chamber and the exhaust air chamber to have two upper and lower independent spaces.

* * * * *